US007020921B2

(12) United States Patent
Wang

(10) Patent No.: US 7,020,921 B2
(45) Date of Patent: Apr. 4, 2006

(54) INFLATING/DEFLATING DEVICE IN COMBINATION WITH AN INFLATABLE MATTRESS HAVING MULTIPLE CHAMBERS

(76) Inventor: Cheng-Chung Wang, 12F, No. 440, Sec. 4, Jen-Ai Rd., Taipei (TW)

( * ) Notice: Subject to any disclaimer, the term of this patent is extended or adjusted under 35 U.S.C. 154(b) by 0 days.

(21) Appl. No.: 10/799,206

(22) Filed: Mar. 12, 2004

(65) Prior Publication Data

US 2005/0044631 A1 Mar. 3, 2005

(30) Foreign Application Priority Data

Aug. 25, 2003 (CN) ..... 03273826 U

(51) Int. Cl.
*A47C 27/10* (2006.01)

(52) U.S. Cl. ..... 5/713; 5/708; 5/706

(58) Field of Classification Search ..... 5/706, 5/710, 713, 644, 654, 655.3, 708; 318/16; 137/565.16, 625.2, 596.1, 883; 251/129.01

See application file for complete search history.

(56) References Cited

U.S. PATENT DOCUMENTS

| | | | | | |
|---|---|---|---|---|---|
| 4,745,647 | A * | 5/1988 | Goodwin | 5/713 |
| 4,768,249 | A * | 9/1988 | Goodwin | 5/713 |
| 4,838,309 | A * | 6/1989 | Goodwin | 137/554 |
| 4,945,590 | A * | 8/1990 | Ogura | 5/713 |
| 4,949,413 | A * | 8/1990 | Goodwin | 5/713 |
| 5,051,673 | A * | 9/1991 | Goodwin | 318/481 |
| 5,373,595 | A * | 12/1994 | Johnson et al. | 5/710 |
| 5,771,514 | A * | 6/1998 | Wilhoit | 5/644 |
| 5,806,110 | A * | 9/1998 | Kunz et al. | 4/566.1 |
| 5,848,450 | A * | 12/1998 | Oexman et al. | 5/713 |
| 6,543,073 | B1 * | 4/2003 | Wu | 5/713 |
| 6,836,914 | B1 * | 1/2005 | Tsai | 5/713 |
| 6,859,967 | B1 * | 3/2005 | Harrison et al. | 5/710 |
| 6,955,527 | B1 * | 10/2005 | Yen | 417/360 |
| 2002/0194678 | A1 * | 12/2002 | Chung | 5/713 |
| 2003/0159219 | A1 * | 8/2003 | Harrison et al. | 5/713 |
| 2005/0044631 | A1 * | 3/2005 | Wang | 5/615 |

* cited by examiner

*Primary Examiner*—Robert G. Santos
(74) *Attorney, Agent, or Firm*—Jackson Walker, LLP

(57) ABSTRACT

An inflating/deflating device in combination with an inflatable mattress having multiple chambers includes a casing with an inlet and three outlets, a pump received in the inlet to provide inflation/deflation to the chambers of the inflatable mattress and multiple controllable valves respectively and movably mounted on the outlets such that the pump is able to inflate/deflate the chambers of the inflatable mattress simultaneously.

6 Claims, 16 Drawing Sheets

INFLATING/DEFLATING DEVICE IN COMBINATION WITH AN INFLATABLE MATTRESS HAVING MULTIPLE CHAMBERS

BACKGROUND OF THE INVENTION

1. Field of the Invention

The present invention relates to an inflating/deflating device and more particularly to the inflating/deflating device in combination with an inflatable mattress having multiple chambers such that the inflating/deflating device is able to inflate or deflate multiple chambers simultaneously.

2. Description of Related Art

It is to be noted that an inflatable mattress has only one chamber defined inside the inflatable mattress such that when a pump is connected to the nozzle on the inflatable mattress, the pump is able to quickly inflate (or deflate) the mattress. However, when the inflatable mattress has more than one chamber defined therein, the user will have to move the pump around to inflate another chamber after the first chamber has been inflated. That is, the user has to individually inflate each and every chamber in the mattress so that the user is able to comfortably lie on the mattress. However, because the user has to move the pump around the mattress to inflate each and every one of the chambers in the mattress, time and effort are wasted in moving, hooking and unhooking the pump to the mattress, etc.

To overcome the shortcomings, the present invention tends to provide an improved inflating/deflating device in combination with an inflatable mattress having multiple chambers to mitigate the aforementioned problems.

SUMMARY OF THE INVENTION

The primary objective of the present invention is to provide an improved inflating/deflating device having an inlet, multiple outlets defined in a casing of the inflating/deflating device, an air pump received in a room in communication with the inlet and multiple electromagnetic valves respectively received in a corresponding one of the outlets, such that after the electromagnetic valves are opened, activation of the air pump is able to conduct inflation/deflation to the chambers simultaneously.

Another objective of the present invention is to provide a linkage in connection with each one of the electromagnetic valves such that each electromagnetic valve is able to be activated or deactivated simultaneously with the other valve.

Other objects, advantages and novel features of the invention will become more apparent from the following detailed description when taken in conjunction with the accompanying drawings.

BRIEF DESCRIPTION OF THE DRAWINGS

FIG. 1-2 is a schematic view showing the inflating/deflating device has pipes in connection and communication with different chambers of the inflatable mattress;

FIG. 2 is a schematic view showing the internal structure of a second embodiment of the inflating/deflating device of the present invention;

DETAILED DESCRIPTION OF THE PREFERRED EMBODIMENT

Figure 1:
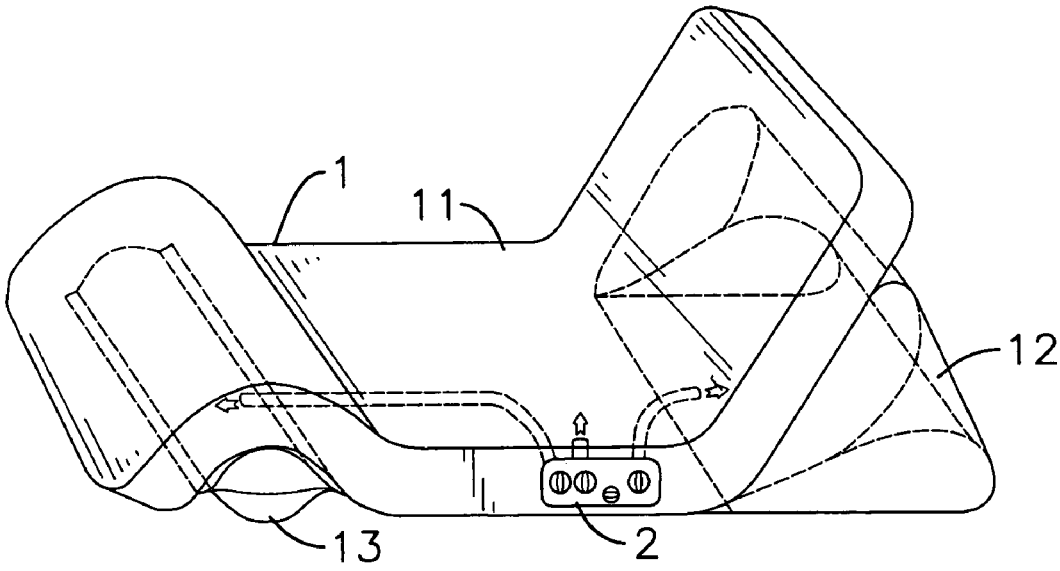
FIG. 1-1 is a perspective view of an inflatable mattress with an inflating/deflating device on the side of the inflatable mattress.
Figures 1, 2:
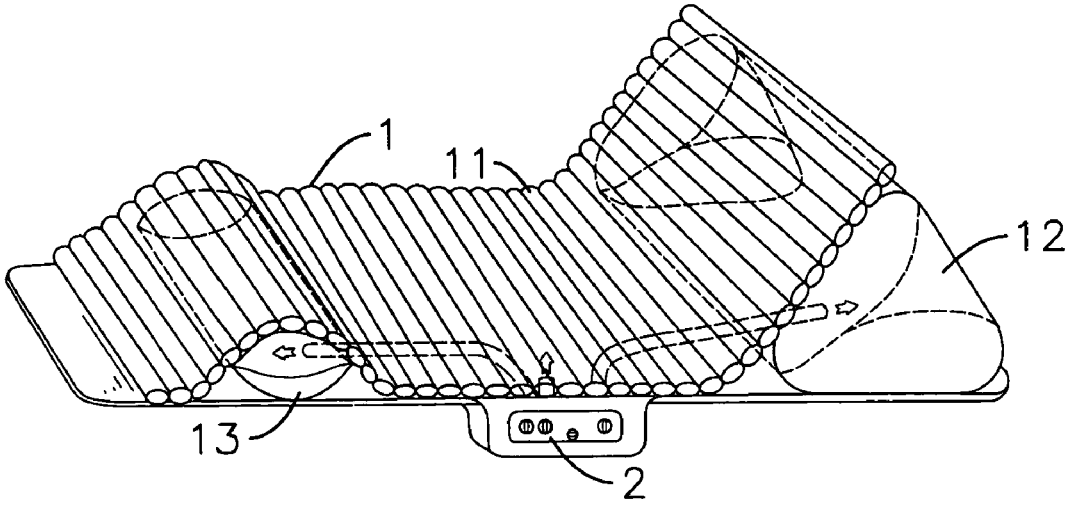
Figure 2:
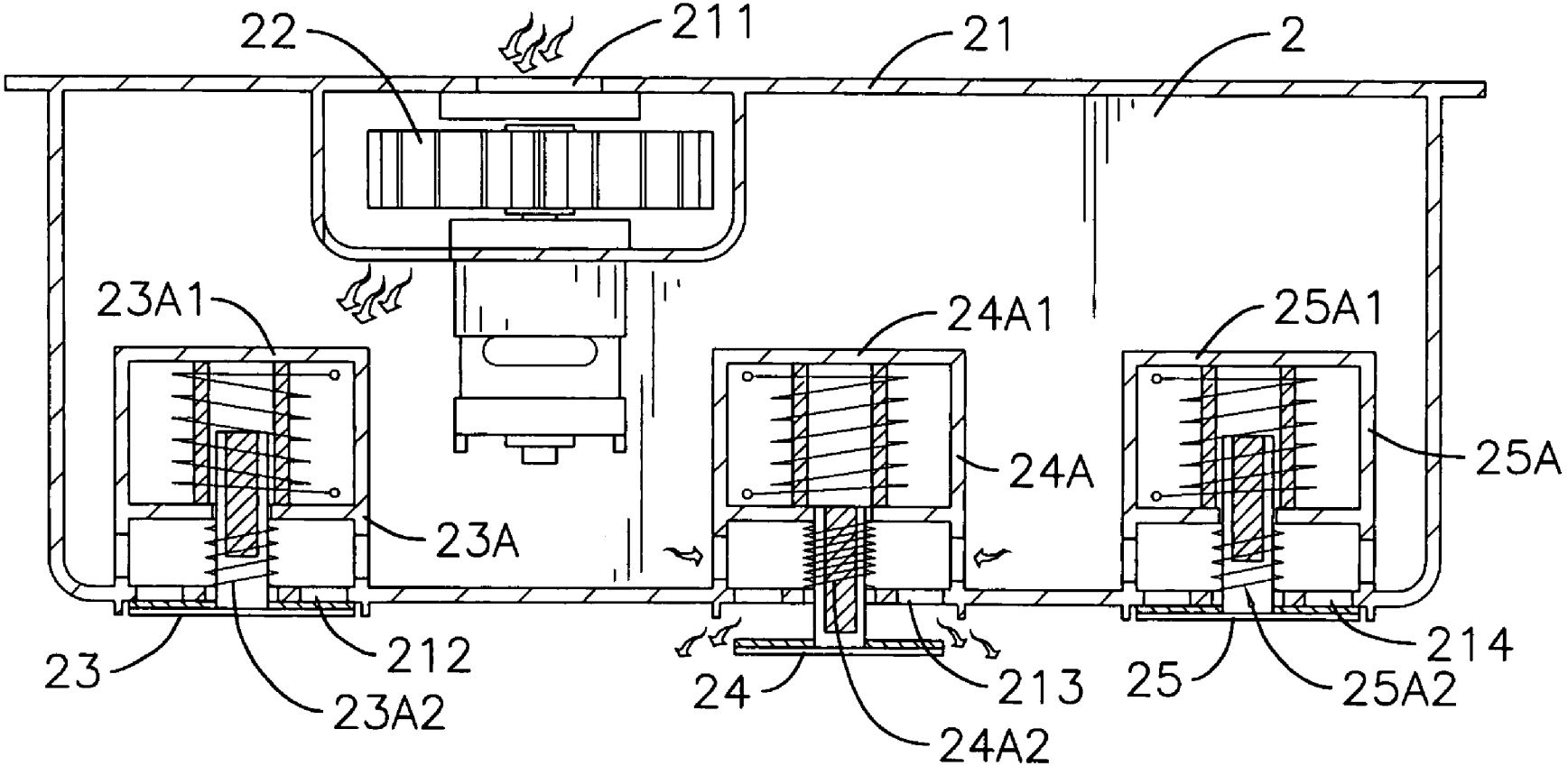

With reference to FIGS. 1-1 and 1-2, it is noted that the inflatable mattress (1) has a main body (11) with a first chamber (12) defined in a front portion of the main body (11) and a second chamber (13) defined in a rear portion of the main body (11). An inflating/deflating device (2) is provided on a side of the main body (11) of the inflatable mattress (1) and has pipes (not numbered) in communication with the first chamber (12) and the second chamber (13) respectively.

With reference to FIG. 2, the inflating/deflating device (2) has a casing (21). The casing (21) is built in the inflatable mattress (1) and has an inlet (211) and three outlets (212, 213,214) respectively defined in side walls of the casing (21). A pump (22) is mounted inside the inlet (21) 50 that the pump 922) is able to suck air from the surrounding environment to the inflatable mattress (1) or deflate the inflatable mattress (1) by forcing the air inside the inflatable mattress (1) out of the inflatable mattress (1) from the inlet (211). Each of the outlets (212,213,214) has a controllable valve (23,24,25) to control opening of the outlets (212,213,214).

The valves (212,213,214) in FIG. 2 are controlled by electromagnetic switches (23A,24A,25A) so that after the coils (23A1,24A1,25A1) respectively mounted on the electromagnetic switches (23A,24A,25A) are energized, under the influence of magnetic field, the valves (23,24,25) are pushed to open and recoil springs (23A2,24A2,25A2) respectively mounted on the electromagnetic switches (23A, 24A,25A) are compressed. Thus the outlets (212,213,214) are open. The operator is able to use the pump (22) to deflate or inflate different portions of the inflatable mattress (1) simultaneously. After the power to the coils (23A1,24A1, 25A1) is terminated, under the influence of recoil force from the springs (23A2,24A2,25A2), the valves (23,24,25) are pushed back to close the outlets (212,213,214).

Figure 3:
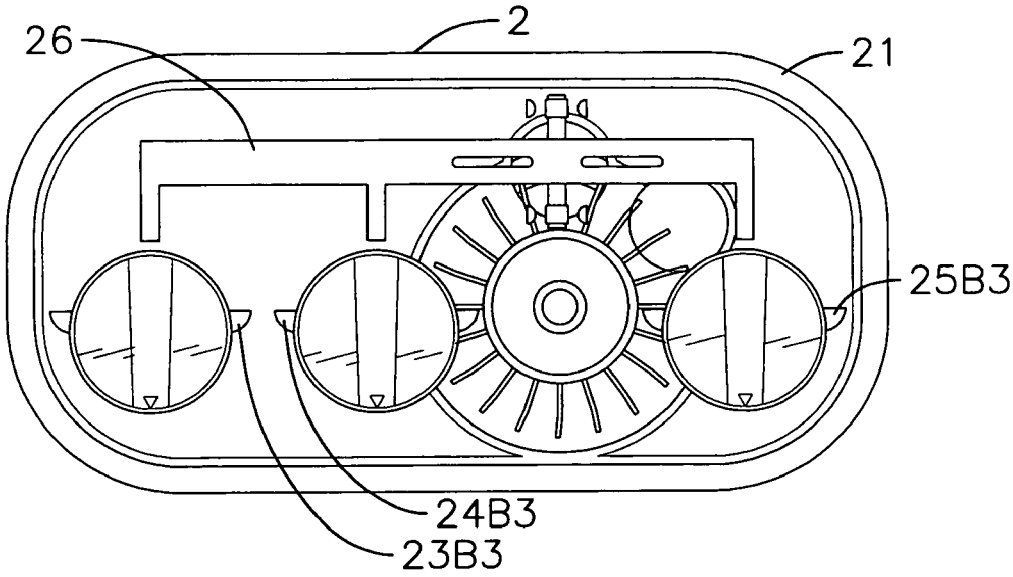
FIG. 3 is a side view of another embodiment of the inflating/deflating device of the present invention.
Figure 4:
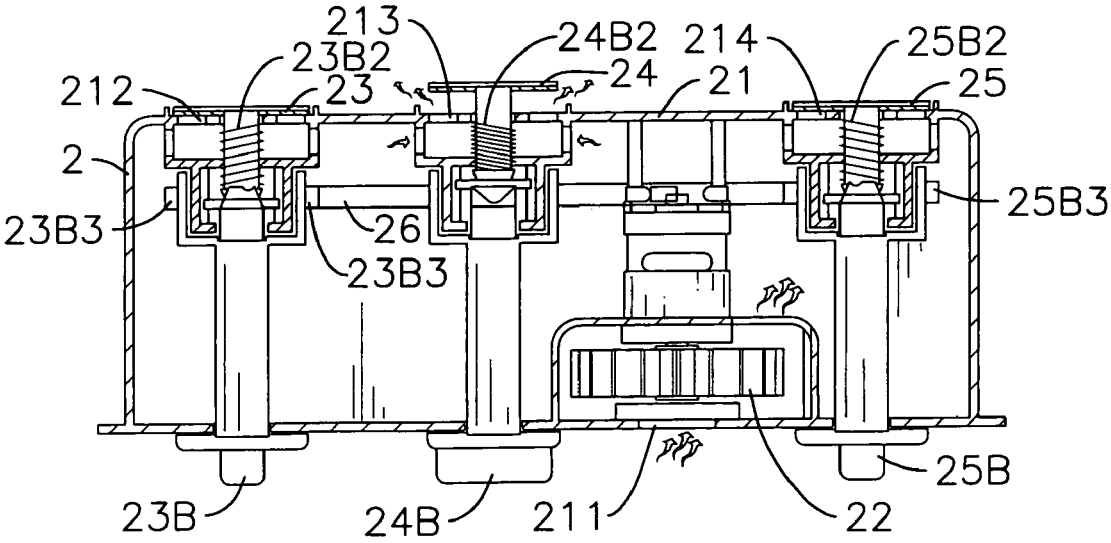
FIG. 4 is a cross sectional view of the inflating/deflating device in FIG. 3.

With reference to FIGS. 3 and 4, rotation of the knobs (23B,24B,25B) in a first direction is able to force the valves (23,24,25) to open the outlets (212,213,214) and compress springs (23B2,24B2,25B2) respectively mounted on the valves (23,24,25). With the activation of the pump (22) inside the inlet (211), the operator is able to inflate or deflate different portions of the inflatable mattress simultaneously. When the knobs (23B,24B,25B) are rotated in a second direction, the springs (23B2,24B2,25B2) are released to push the valves (23,24,25) back to close the outlets (212, 213,214). Further a linkage (26) is provided to connect to each of the knobs (23B,24B,25B) and has three sets of ears (23B3,24B3,25B3) respectively formed on both sides of the knobs (23B,24B,25B) to ensure that the knobs (23B,24B, 25B) can only be rotated simultaneously or individually in the same direction. Therefore, the operator is able to control the inflating portion inside the inflatable mattress to have different portions of the operator's body to be supported simultaneously or individually. For example, the operator is able to inflate the first chamber (12) of the inflatable mattress (1) to have full support to the operator's upper body or the operator is able to inflate the second chamber (13) to have full support to the operator's legs, as shown in FIGS. 1-1 and 1-2.

Figure 5:
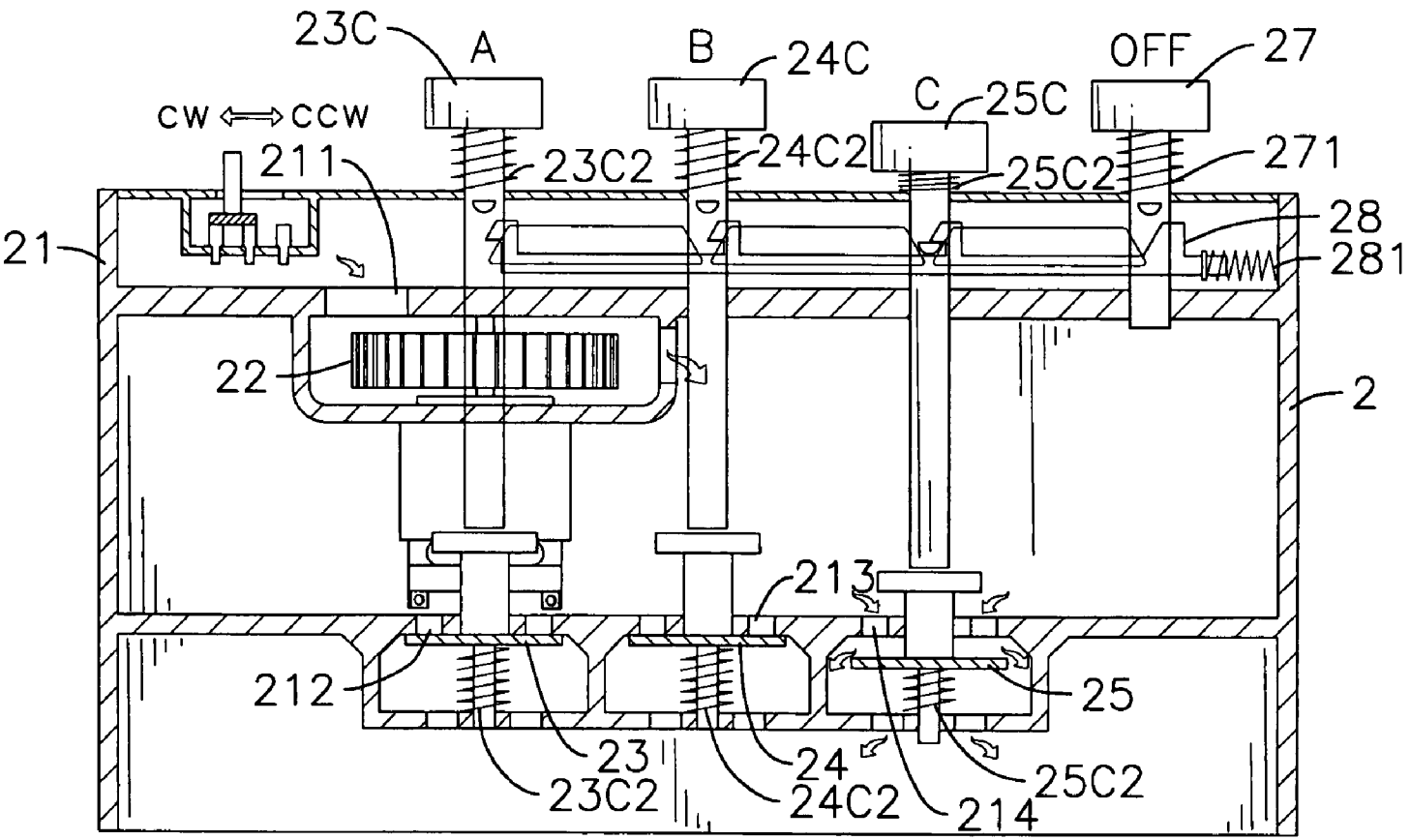
FIGS. 5 and 6 are cross sectional views of the third embodiment of the present invention.
Figure 6:
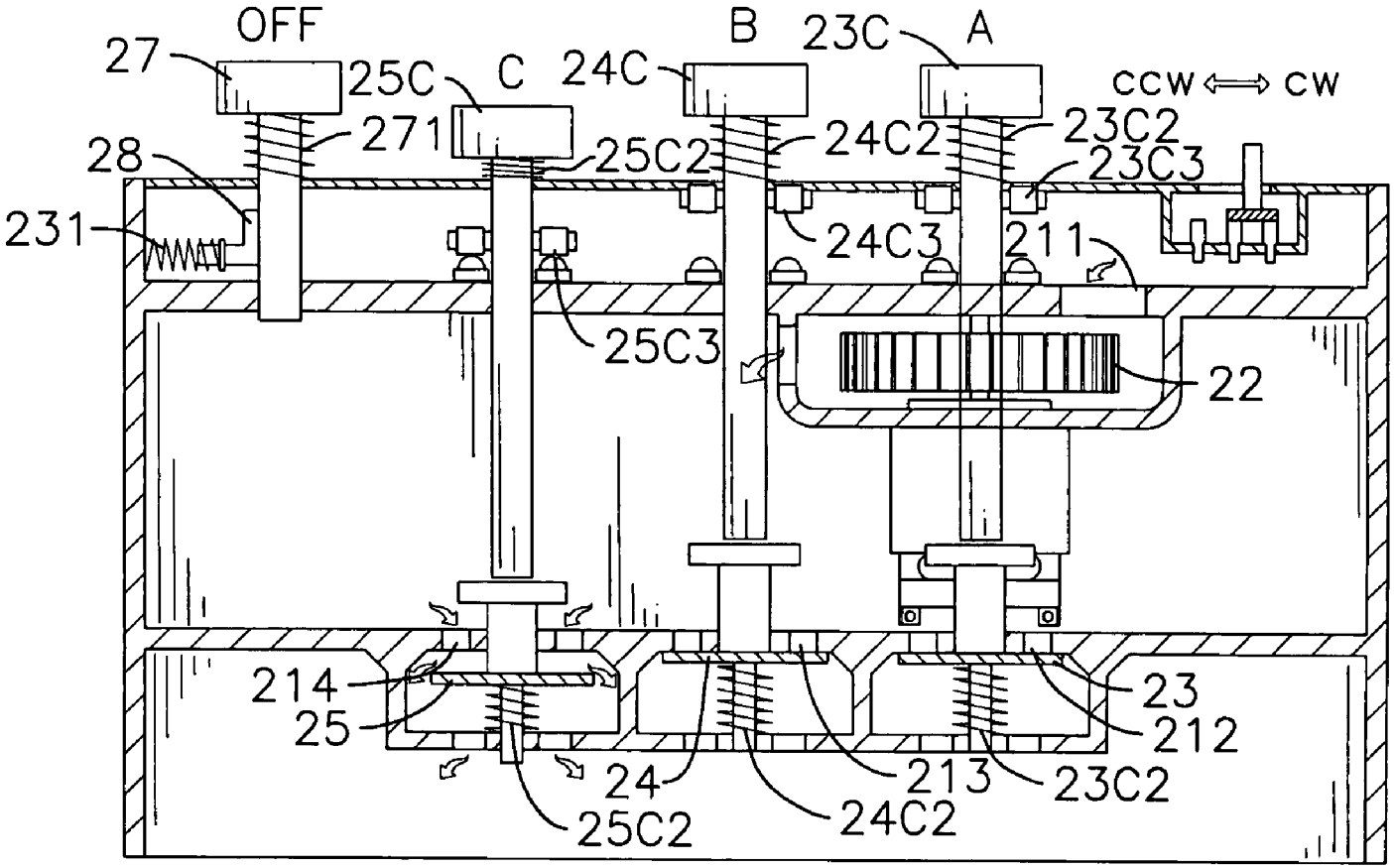
Figure 7:
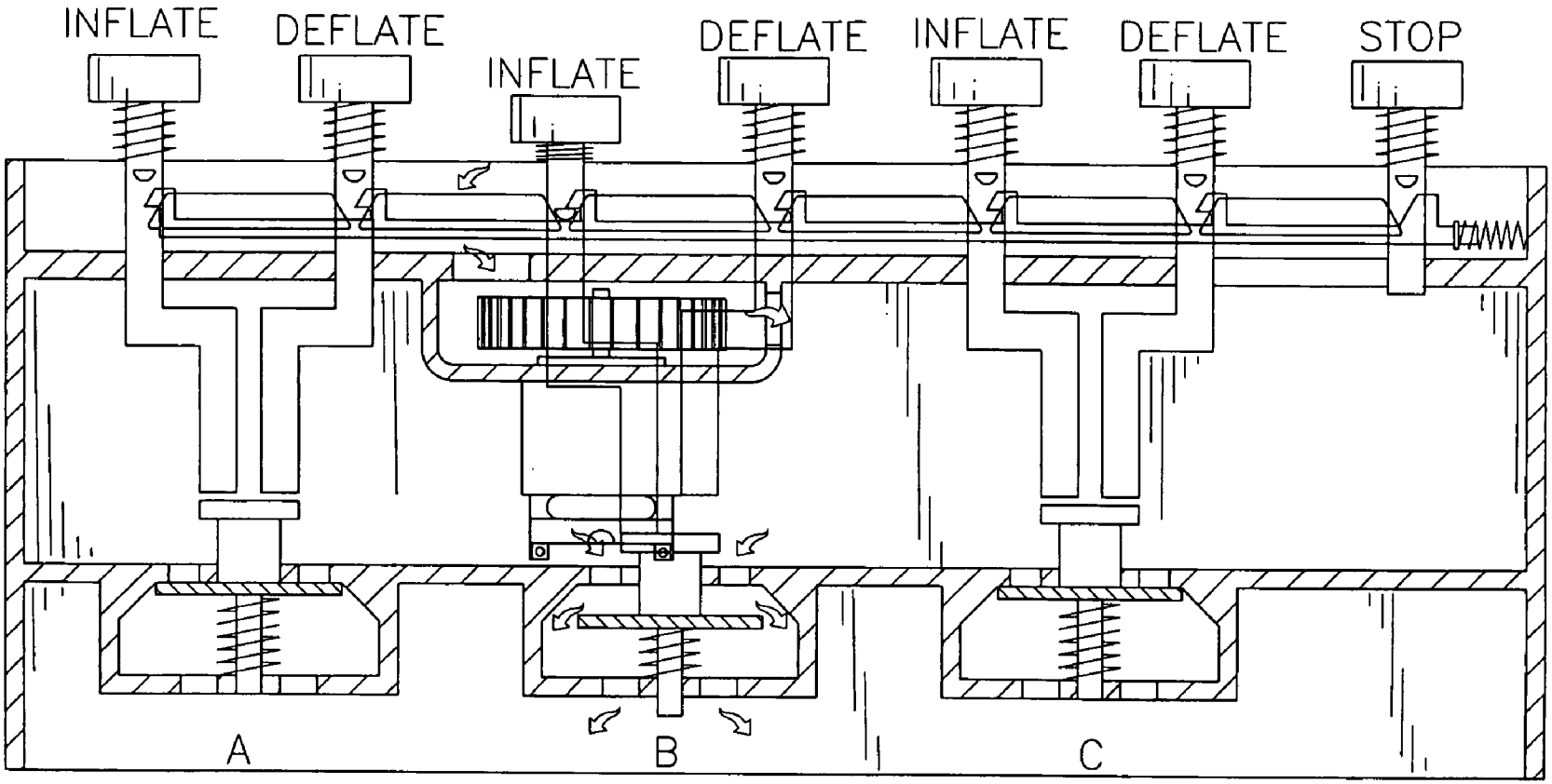
FIGS. 7 and 8 are cross sectional views of the fourth embodiment of the present invention.

With reference to FIG. 5, the controlling mechanism may adopt the pushbuttons (23C,24C,25C). The pushbuttons (23C,24C,25C) are pushed to open the valves (23,24,25) and controlled by a linkage (28). In the meantime, springs (23C2,24C2,25C2) are compressed and outlets (212,213, 214) are open. Therefore, the operator is able to use the pump (22) to inflate or deflate different portions of the inflatable mattress. When a master pushbutton (27) is pressed, the pushbuttons (23C,24C,25C) are released from the linkage (28). Under the influence of the springs (23C2, 24C2,25C2), the valves (23,24,25) close the outlets (212, 213,214). Thereafter, the master pushbutton (27) and the linkage (28) return to their original positions under the influence of springs (271,281). As shown in FIG. 6, it is noted that the pushbuttons (23C,24C,25C) are respectively provided with contact switches (23C3,24C3,25C3).

Figure 8:
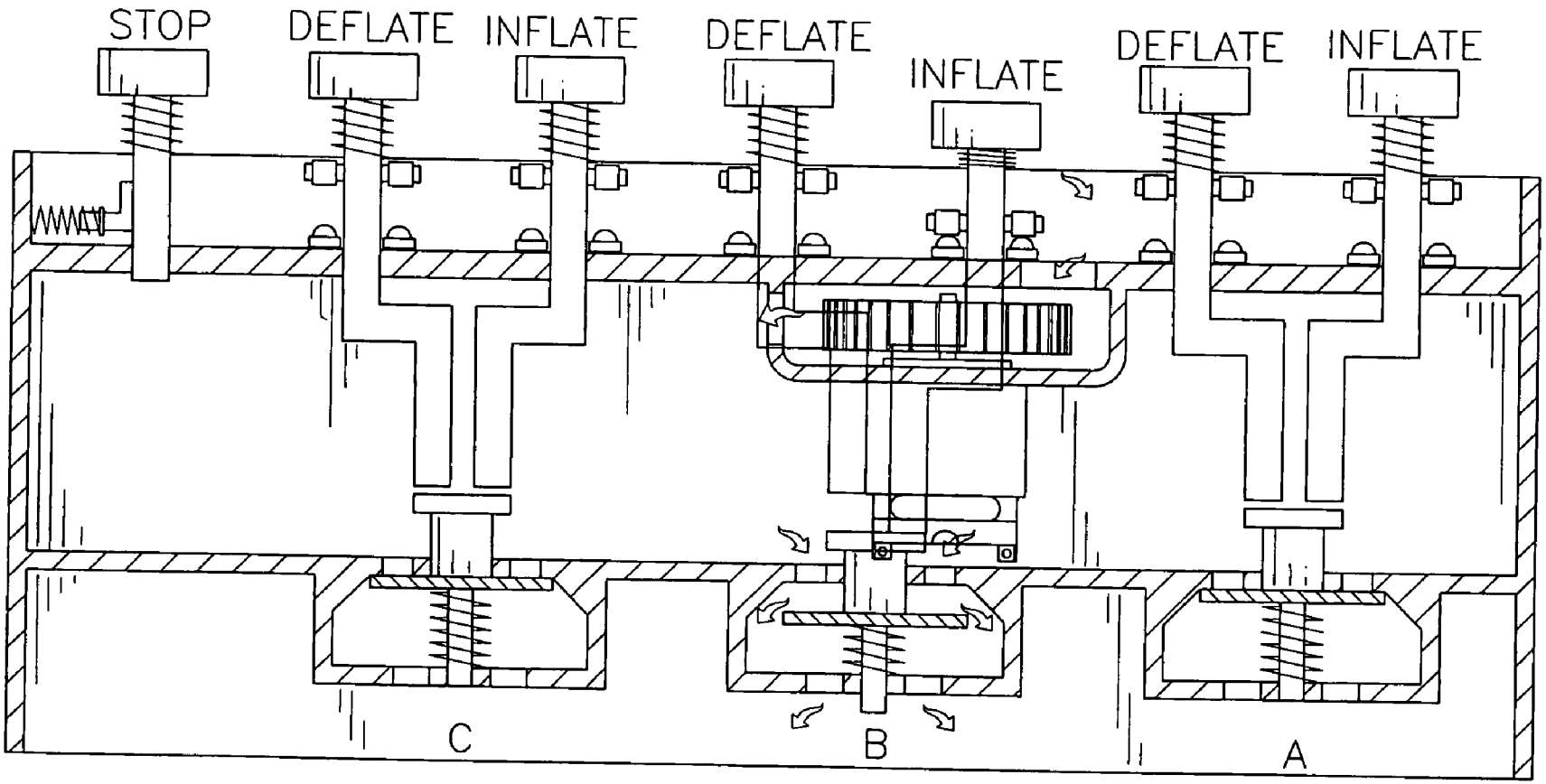
Figure 9:
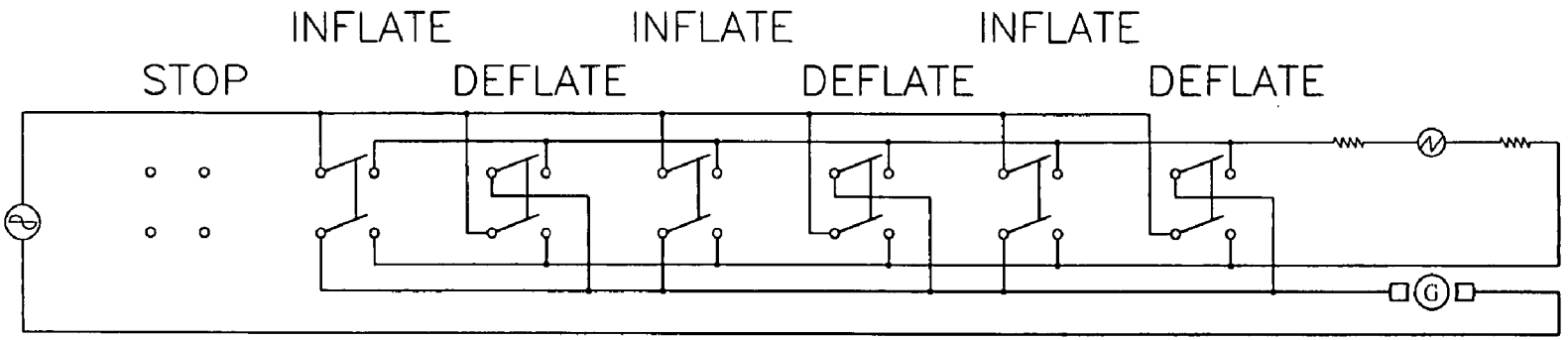
FIG. 9 is a circuit diagram applied to the embodiment in FIG. 7, wherein the power to the circuit diagram is alternating current.
Figure 10:
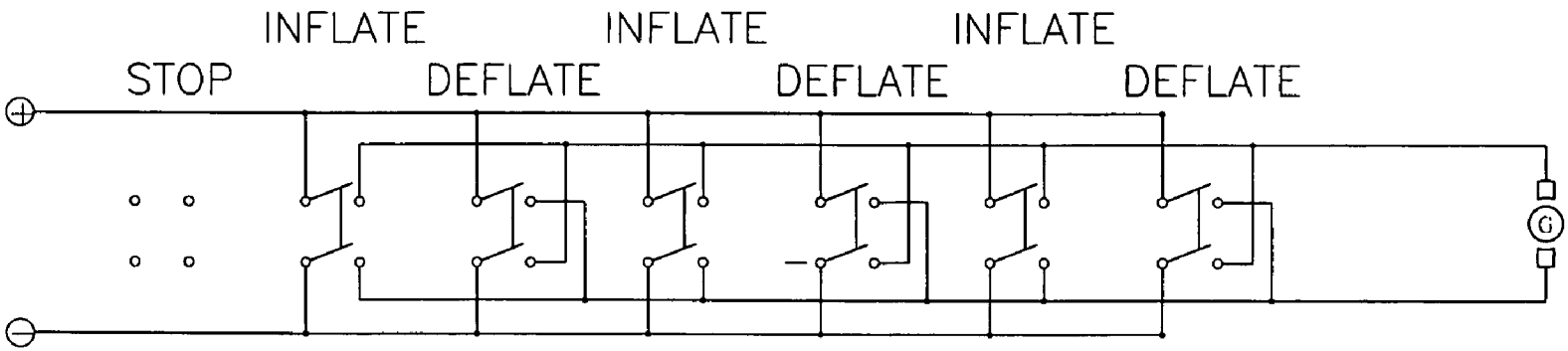
FIG. 10 is a circuit diagram applied to the embodiment in FIG. 7, wherein the power to the circuit diagram is direct current.
Figure 11:
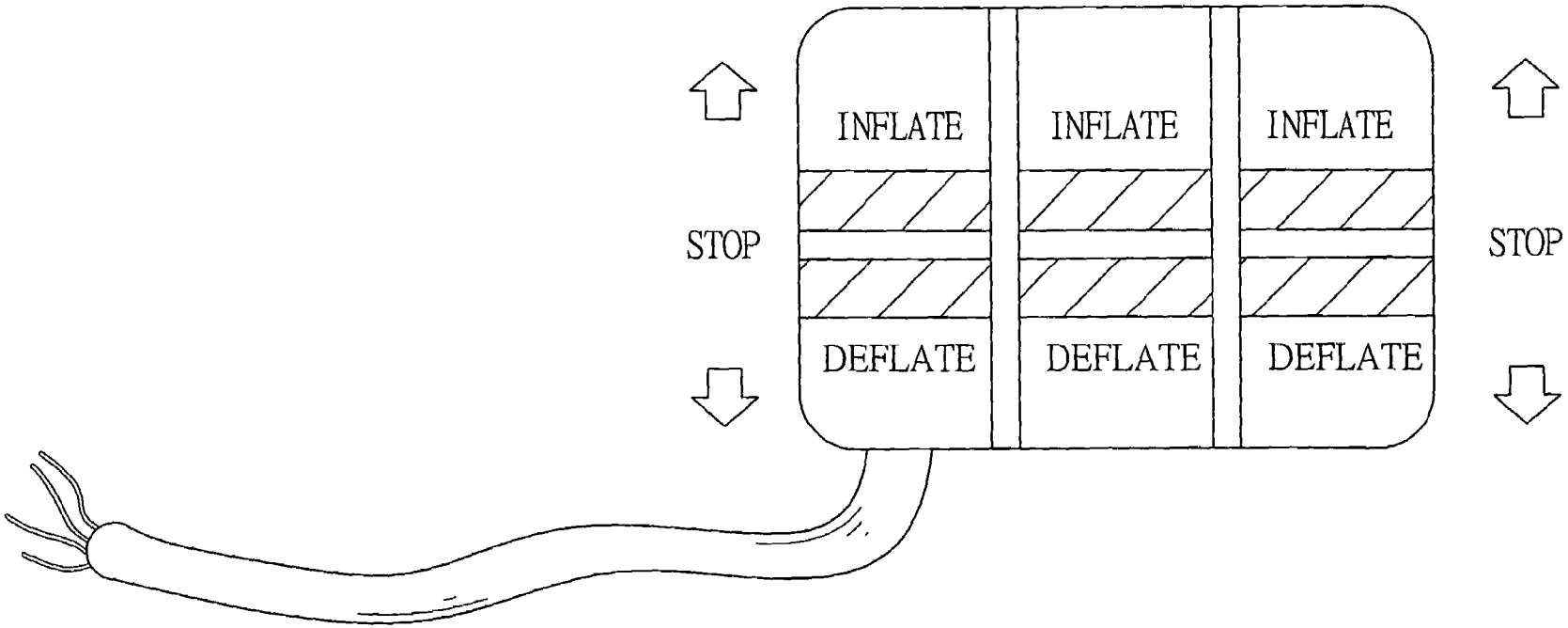
FIG. 11 is a schematic view showing the inflating/deflating device used to inflate/deflate the inflatable mattress having three chambers.
Figure 12:
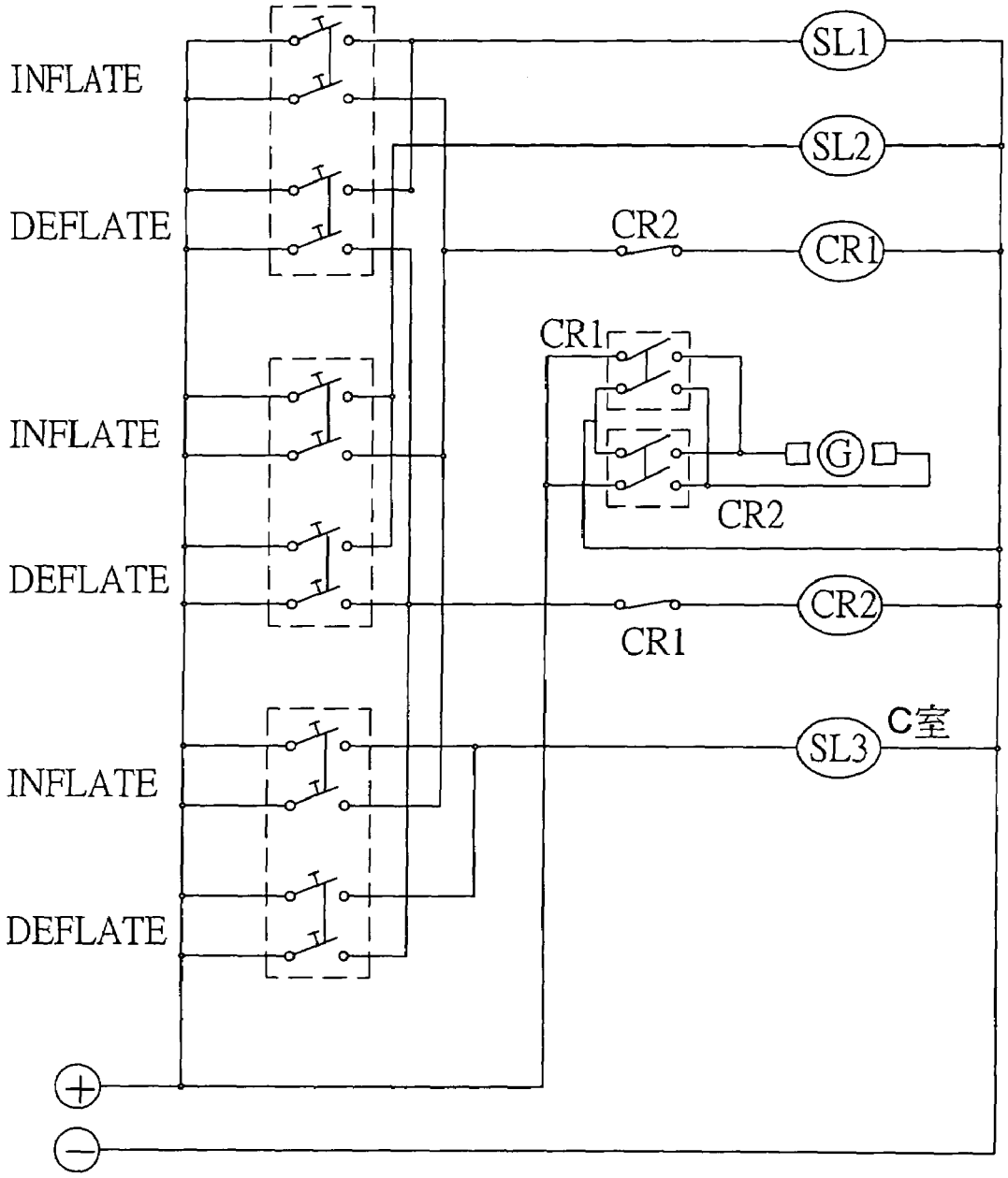
FIG. 12 is a circuit diagram applied to the embodiment in FIG. 11, wherein the power is direct current.
Figure 13:
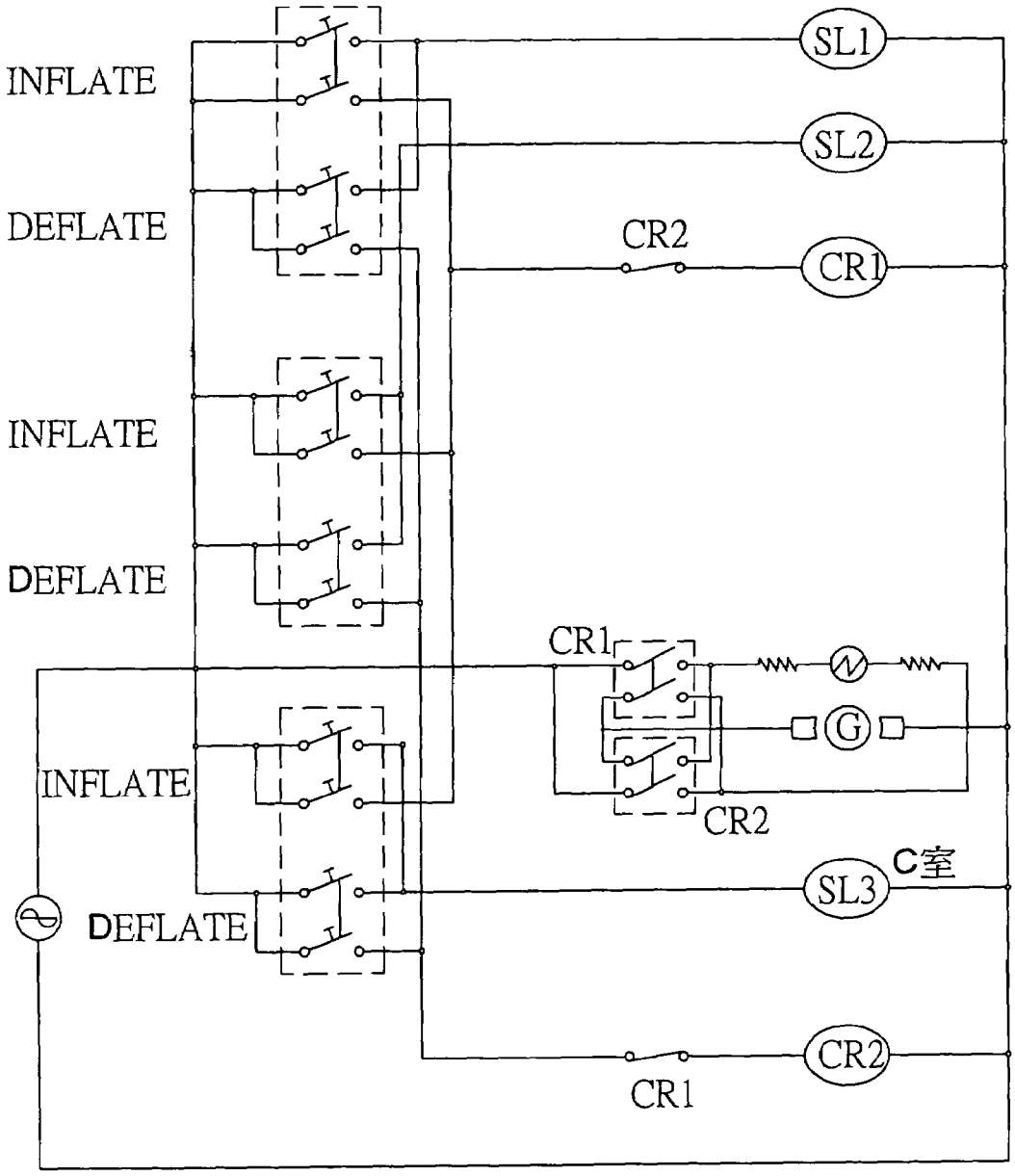
FIG. 13 is a circuit diagram applied to the embodiment in FIG. 11, wherein the power is alternating current.
Figure 14:
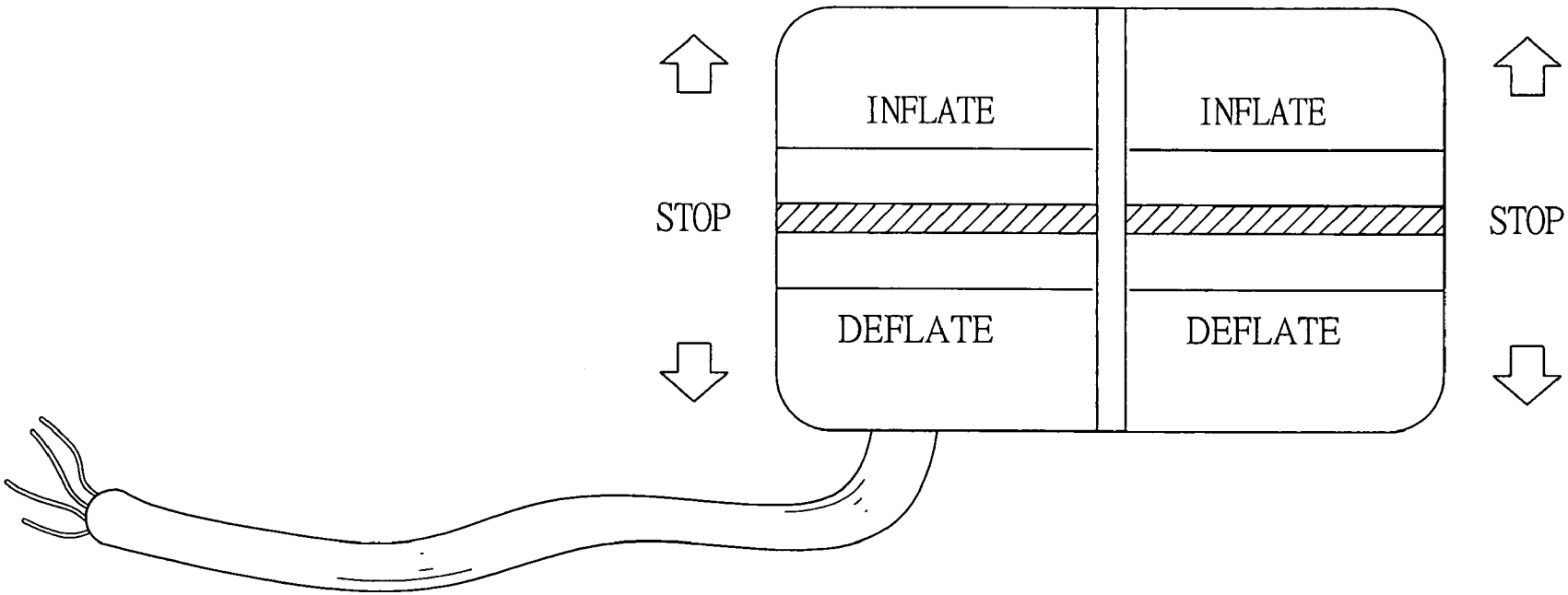
FIG. 14 is a schematic view showing the inflating/deflating device applied to the inflatable mattress having two chambers.
Figure 15:
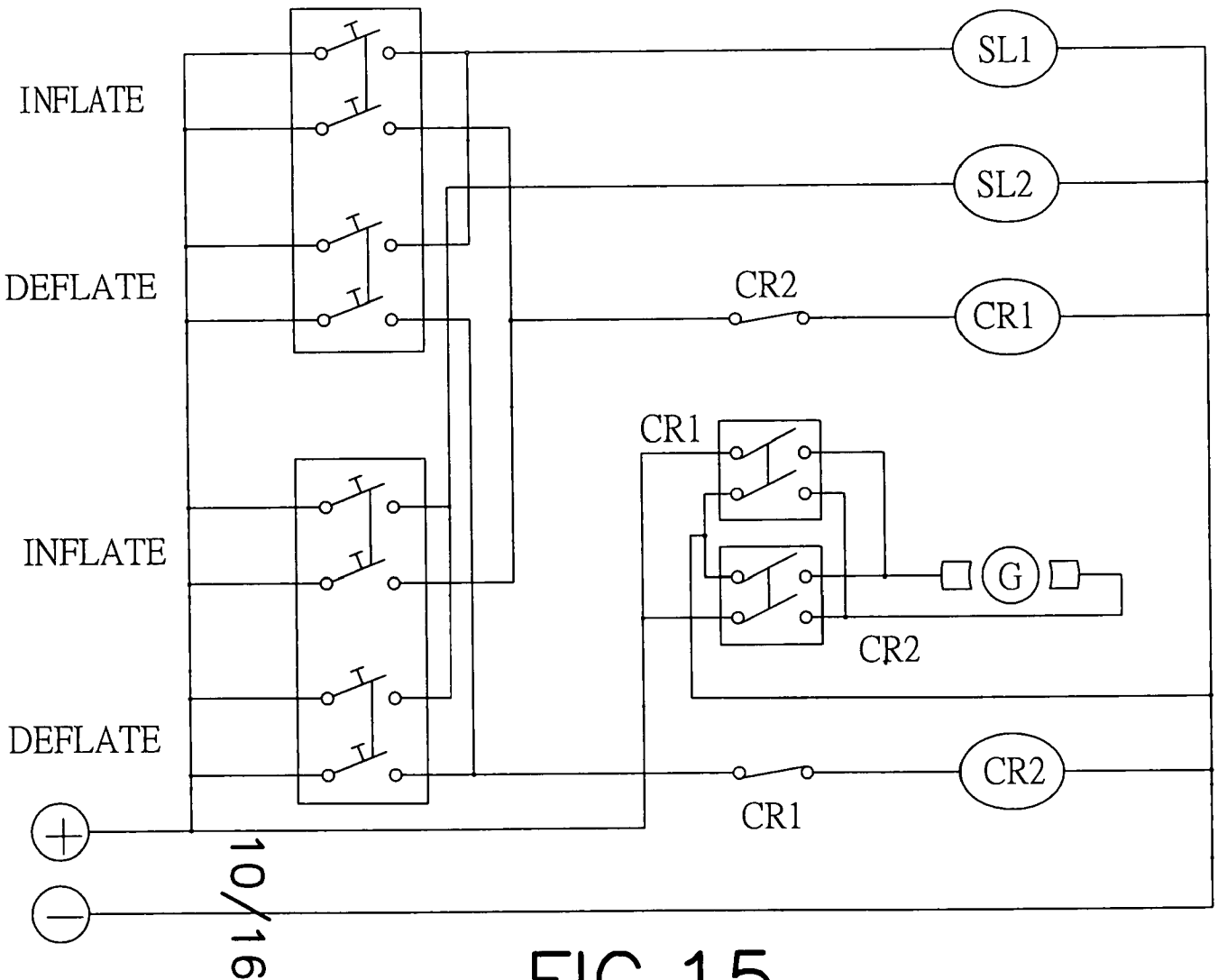
FIG. 15 is a circuit diagram applied to the embodiment in FIG. 14, wherein the power is direct current.
Figure 16:
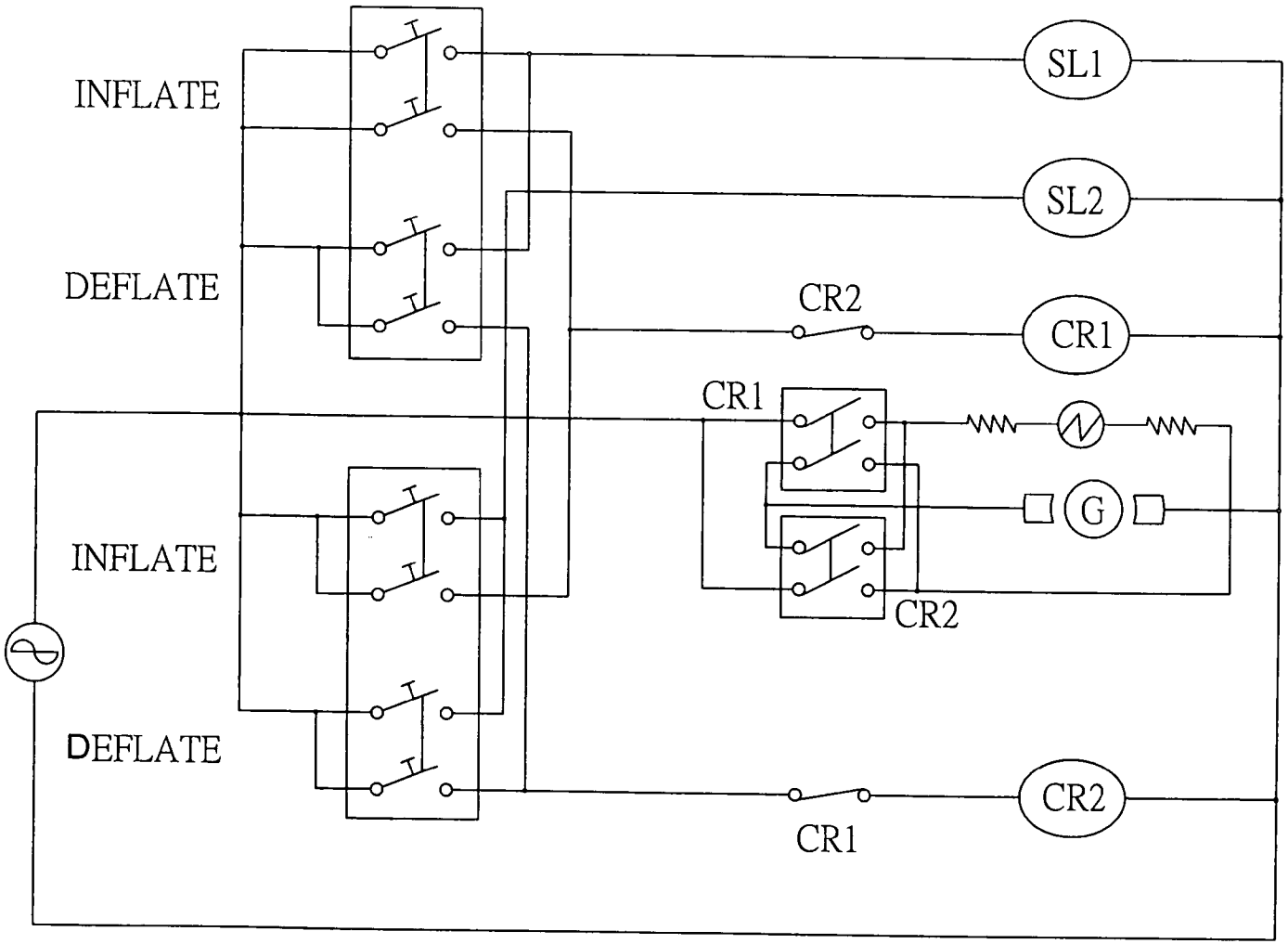
FIG. 16 is a circuit diagram applied to the embodiment in FIG. 14, wherein the power is alternating current.
Figure 17:
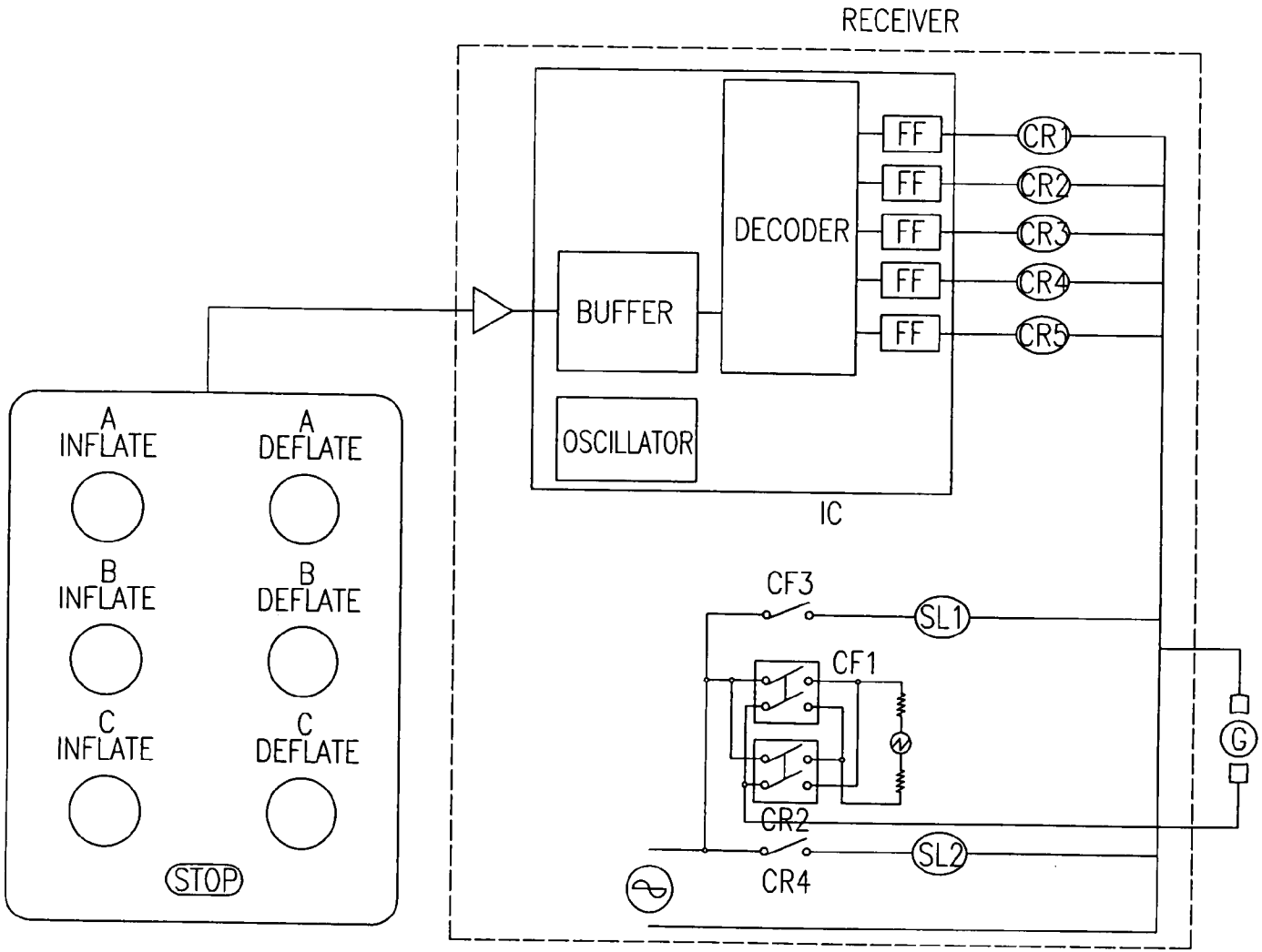
FIG. 17 is a schematic view showing the inflating/deflating device provided with cable control mechanism.

With reference to FIGS. 8 to 10, it is noted that the controlling mechanism of the valves (23,24,25) may also control the rotation direction of the pump (22). A stop switch is the same as that of the master switch to release limitations to the other switches such that detailed description is omitted.

With reference to FIGS. 11 to 17, it is noted that a wire controlling circuit in different embodiments is shown.

Figure 18:
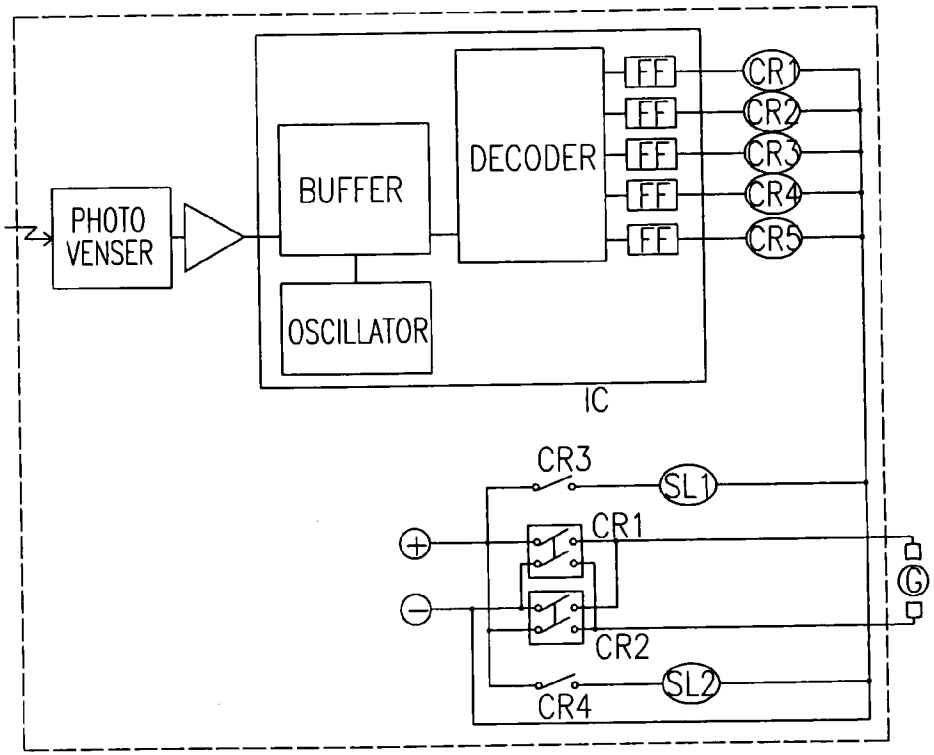
FIG. 18 is a schematic view showing the inflating/deflating device provided with a radio control mechanism.
Figure 18:
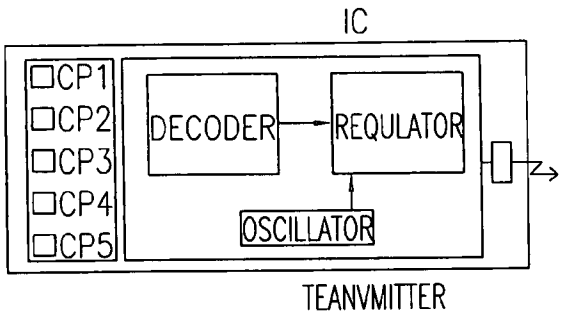
Figure 18:
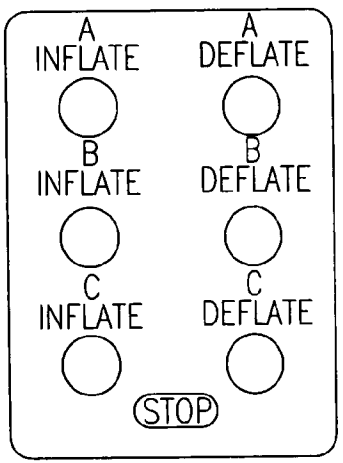
Figure 18:
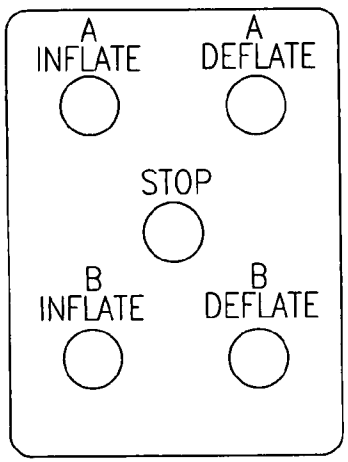

FIG. 18 shows a wireless controlling circuit to be used in the controlling mechanism of the present invention. However, because the knowledge of wireless control is conventional, detailed description is omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inflating device provided to an inflatable mattress having multiple chambers to inflate the multiple chambers simultaneously or separately, wherein the inflating device comprises:

a case built in the inflatable mattress and having at least one inlet and multiple outlets corresponding to the multiple chambers;

a pump connected to the at least one inlet to provide inflation to the multiple chambers of the inflatable mattress; and multiple controllable valve elements, each having at least one spring, an electromagnetic switch and a controllable valve, connected to the corresponding outlets such that the pump is able to inflate/deflate the multiple chambers of the inflatable mattress simultaneously or separately;

wherein said multiple controllable valve elements control the movement of the respective controllable valve to open/close the outlet.

2. The inflating device in combination with an inflatable mattress having multiple chambers as claimed in claim 1 further comprising a master switch provided to control movement of the at least one electromagnetic switches of the valves.

3. The inflating device in combination with an inflatable mattress having multiple chambers as claimed in claim 1, wherein an inflate switch and a deflate switch are provided to respectively control an inflation and a deflation functions of the pump.

4. The inflating device in combination with an inflatable mattress having multiple chambers as claimed in claim 1, wherein a wire control mechanism is provided to control the movement of the valves.

5. The inflating device in combination with an inflatable mattress having multiple chambers as claimed in claim 1, wherein a wireless control mechanism is provided to control the movement of the valves.

6. The inflating device in combination with an inflatable mattress having multiple chambers as claimed in claim 1, wherein the pump both provides inflation and deflation to the multiple chambers of the inflatable mattress.

* * * * *